US006388214B1

(12) United States Patent
Jones et al.

(10) Patent No.: US 6,388,214 B1
(45) Date of Patent: May 14, 2002

(54) MECHANICAL AND GATE FOR INTERLOCKING ELECTRIC POWER SWITCHES AND DISTRIBUTION SYSTEM INCORPORATING SAME

(75) Inventors: William John Jones, Cranberry Township; Raymond Clyde Doran, Jeannette, both of PA (US)

(73) Assignee: Eaton Corporation, Cleveland, OH (US)

( * ) Notice: Subject to any disclaimer, the term of this patent is extended or adjusted under 35 U.S.C. 154(b) by 12 days.

(21) Appl. No.: 09/705,548

(22) Filed: Nov. 3, 2000

(51) Int. Cl.[7] ..... H01H 9/20; H01H 9/26

(52) U.S. Cl. ..... 200/50.33; 200/50.01; 200/50.37; 200/5 B; 307/64

(58) Field of Search ..... 200/50.01, 50.32, 200/50.33, 50.34, 50.37, 17 R, 18, 1 R, 5 B; 307/64

(56) References Cited

U.S. PATENT DOCUMENTS 4,286,242 A 8/1981 Mrenna et al.
5,023,469 A 6/1991 Bassett et al.
5,436,415 A 7/1995 Smith et al.
5,581,133 A 12/1996 Smith et al.
5,847,341 A * 12/1998 Godesa ..... 200/331
5,902,974 A * 5/1999 Fogle et al. ..... 200/43.16
5,914,467 A 6/1999 Jonas et al.
5,929,405 A 7/1999 Wehrli, III et al.
6,060,668 A * 5/2000 Azzola et al. ..... 200/1 R

* cited by examiner

*Primary Examiner*—Karl D. Easthom
*Assistant Examiner*—Kyung Lee
(74) *Attorney, Agent, or Firm*—Martin J. Moran

(57) ABSTRACT

A mechanical AND gate has a pivot plate with an elongated slot engaged by an output coupling formed by a pair of pins radially offset from the end of an output shaft. A pair of input couplings secured to the pivot plate at points laterally offset on opposite sides of the elongated slot couple first and second elongated actuators to the pivot plate. Movement of only one of the elongated actuators to an ON position causes the pivot plate to translate relative to the output coupling, but not to rotate. However, when the second actuator is moved to an ON position in a direction parallel but opposite to the movement of the first actuator, the pivot plate rotates to rotate the output coupling, and therefore, the output shaft. This mechanical AND gate has particular application to interlocking three electric power switches such as circuit breakers so that any two, but not all three, circuit breakers may be on at one time.

14 Claims, 6 Drawing Sheets

MECHANICAL AND GATE FOR INTERLOCKING ELECTRIC POWER SWITCHES AND DISTRIBUTION SYSTEM INCORPORATING SAME

BACKGROUND OF THE INVENTION

1. Field of the Invention

This invention relates to a mechanical device for interlocking multiple electric power switches in a distribution system which by providing a mechanical output only upon the occurrence of mechanical movement of both of two mechanical inputs.

2. Background Information

There are applications where it is necessary to coordinate the operation of electric power switches. For instance, in electrical distribution systems it is often required to mechanically interlock two or more circuit breakers so that only certain closure combinations are possible. A common example is the use of two or more power sources which may have slightly different voltage, frequency or phase angles and whose simultaneous connection to the same distribution bus could produce a "fault" current. To facilitate the use of mechanical interlocking schemes, each circuit breaker is equipped with an output indication device which produces a motion when the breaker is closed and an input device which trips the breaker open, or holds it trip-free, when it receives an input signal in the form of a mechanical motion.

Where the operation of two switches is interlocked, such as in the case of a transfer switch for connecting alternate power sources to a distribution system, the output indication device on each switch is connected to the input or auxiliary trip device on the other so that only one switch can be on at a time. One arrangement for accomplishing this is disclosed in co-pending, commonly owned, application serial number 09/559,089, filed on Apr. 27, 2000. This system uses OR gates formed by doubled-ended levers, which when pulled at either end rotate the output shaft, although in the two switch combination only one input is utilized.

One of the most complex mechanical interlocking schemes involves three interlocked circuit breakers, any two of which can be closed at once. An example of its use is a "double-ended" switchboard with two independent sources and a split main bus than can be connected with a "tie" breaker. It is desirable to prevent simultaneous connection of both sources to the main bus, unless the tie breaker is open. But, if either of the main breakers is open, the tie breaker can be closed, thus feeding the split bus from a single source. This form of three-way mechanical interlock requires an AND logic element. Each breaker receives an input signal (motion) from the other two. Either signal alone will not operate the tripping device; it takes the combination of both inputs to produce the output (trip) response.

There is a need therefore for a mechanical AND gate to provide this logical response. This mechanical AND gate should have characteristics which make it simple and inexpensive to produce and install. Because the AND gate will be used less frequently, it is desirable that it be adapted to be interchanged with the simple OR gate currently used in simpler interlock arrangements. For proper operation, the AND gate should respond with no rotation if one input alone is present and with full rotation if both inputs are present. For design commonality it is also desirable that the input motions used with the AND gate be of the same magnitude and direction as those used for the OR gate with which it can be interchanged.

SUMMARY OF THE INVENTION

These needs and others are satisfied by the invention which is directed to a mechanical AND gate having a "floating pivot". More particularly, the mechanical AND gate comprises a pivot plate having an elongated slot. A first input coupling is mounted to the pivot plate at a point laterally offset to a first side of the elongated slot. A second input coupling is mounted to the pivot plate at a point laterally offset to a second side of the elongated slot. The output shaft of the gate extends transversely toward the pivot plate in alignment with the elongated slot. An output coupling mounted on but radially offset from the output shaft engages and is slideable relative to the pivot plate in the elongated slot. A first elongated actuator engages the first input coupling and is axially moveable between ON and OFF positions. Similarly, a second elongated actuator engages the second input coupling and is also axially movable between ON and OFF positions. The first and second input couplings are structured to only transfer force from the respective elongated actuators to the pivot plate with movement toward the ON position so that the pivot plate slides relative to the output coupling engaging the elongated slot, when only one of the elongated actuators moves to the ON position yet rotates to rotate the output coupling and therefore the output shaft only when both of the elongated actuators move toward their respective ON positions.

In the exemplary embodiment of the invention, the elongated actuators are positioned to move along substantially parallel strokes in opposite directions from their respective OFF to ON positions and the pivot plate has an OFF position in which the elongated slot is substantially parallel to the strokes of the elongated actuator.

More particularly, each of the input couplings is structured and positioned to provide lost motion between the associated elongated actuators and the pivot plate when the other of the elongated actuators moves to its ON position and translates the pivot plate, the lost motion being taken up as the other elongated actuator reaches its ON position. Preferably, the input couplings are slip couplings comprising a coupling element which slides relative to the elongated actuator to provide the lost motion and which engages an abutment surface on the elongated actuator to couple the elongated actuator to the pivot plate when the lost motion is taken up. This coupling element can be a swivel, including a swivel ring, through which the elongated actuator slides and seats against an abutment formed by a lateral shoulder on the elongated actuator.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be shown as applied to electric power switches in a double-ended switchboard in an electric power distribution system; however, it should be understood that the invention has application to other arrangements of electric power switches.

Figure 1:
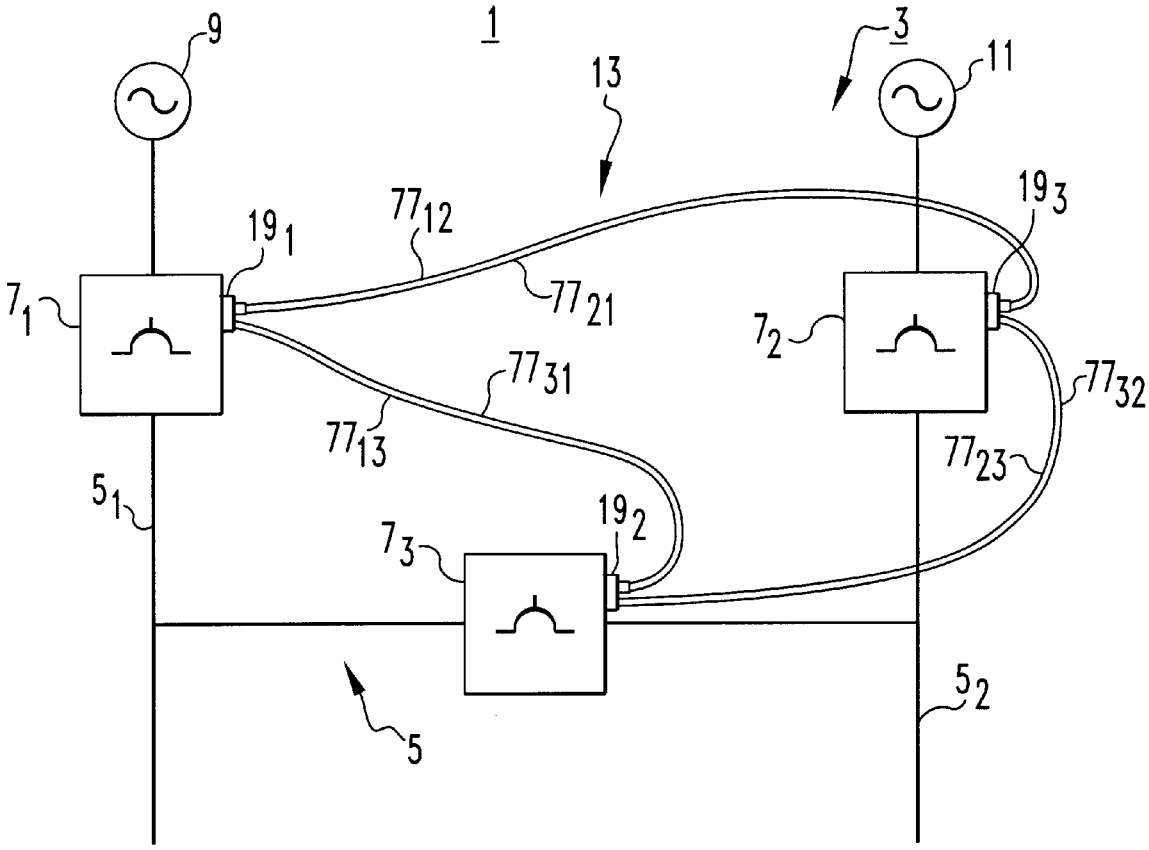
FIG. 1 is an isometric view of an electric power distribution system incorporating the invention.

FIG. 1 illustrates a double-ended switchboard 1 in an electric power distribution system 3. Such an arrangement includes a split main bus 5 having a first side $\mathbf{5}_1$ which is connected through a first main circuit breaker $\mathbf{7}_1$ to a first source 9. The other half $\mathbf{5}_2$ of the split main bus 5 is connected through a second main circuit breaker $\mathbf{7}_2$ to a second source 11. A tie circuit breaker $\mathbf{7}_3$ interconnects the two halves $\mathbf{5}_1$ and $\mathbf{5}_2$ of the split main breaker 5. With this arrangement, either source 9 or 11 can energize the entire split bus, or the source 9 can energize the left slide $\mathbf{5}_1$ of the main bus while the source 11 energizes the right side $\mathbf{5}_2$. The interlocked-tie circuit breaker $\mathbf{7}_3$ prevents interconnection of the two sources. Thus, if both sources 9 and 11 are connected to the main bus through their respective main circuit breakers $\mathbf{7}_1$ and $\mathbf{7}_2$, the tie circuit breaker $\mathbf{7}_3$ should be open. If either of the main breakers $\mathbf{7}_1$ or $\mathbf{7}_2$ is open, the tie breaker $\mathbf{7}_3$ can be closed so that the other source supplies the entire split main bus 5. The latter situation could occur, for instance, if one of the sources and/or its main breaker failed or was taken out of service. As will be appreciated then, only two out of the three circuit breakers $\mathbf{7}_1$–$\mathbf{7}_3$ can be closed at any one time. The interlock system 13 of the invention insures this functionality.

Figure 2:
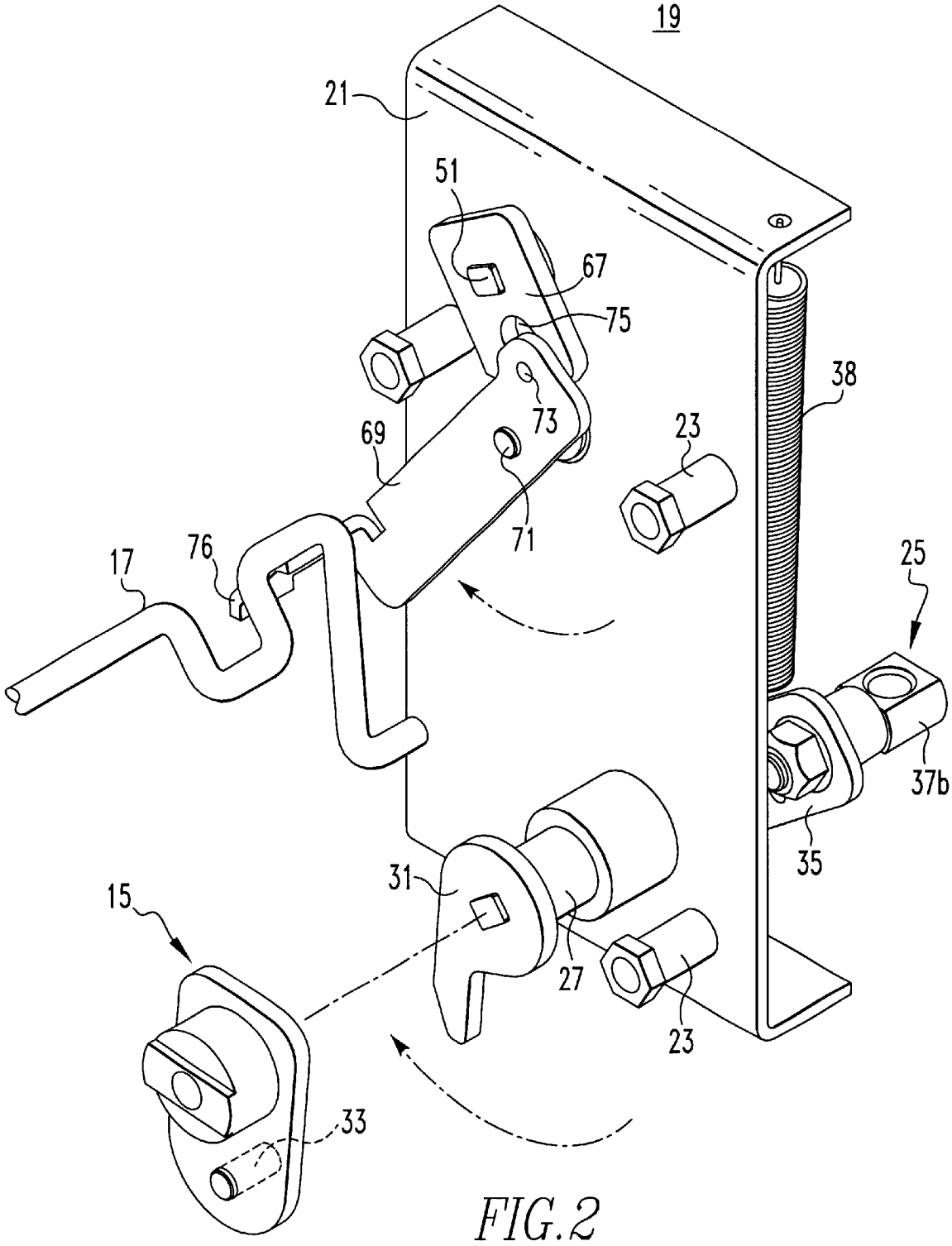
FIG. 2 is an isometric view of the rear of an interlock in accordance with the invention illustrating its interaction with an electric power switch.

The circuit breakers $\mathbf{7}_1$–$\mathbf{7}_3$ are power breakers of the type which have a pole shaft (not shown) which rotates with the opening and closing of the circuit breaker. Referring to FIG. 2, a state indicator 15 mounted on the end of the pole shaft rotates with the shaft to provide an output indicating the open/closed state of the circuit breaker. Each circuit breaker $\mathbf{7}_1$–$\mathbf{7}_3$ also has an input in the form of an auxiliary trip bar 17 which when rotated holds the circuit breaker in the tripped or open position.

Returning to FIG. 1, the interlock system 13 interconnects the state indicator (output) 15 on each of the breakers with the auxiliary trip bar (input) 17 on each of the other breakers. This interlock system 13 includes an interlock unit 19 mounted on each circuit breaker over the state indicator and auxiliary trip bar.

Figure 3:
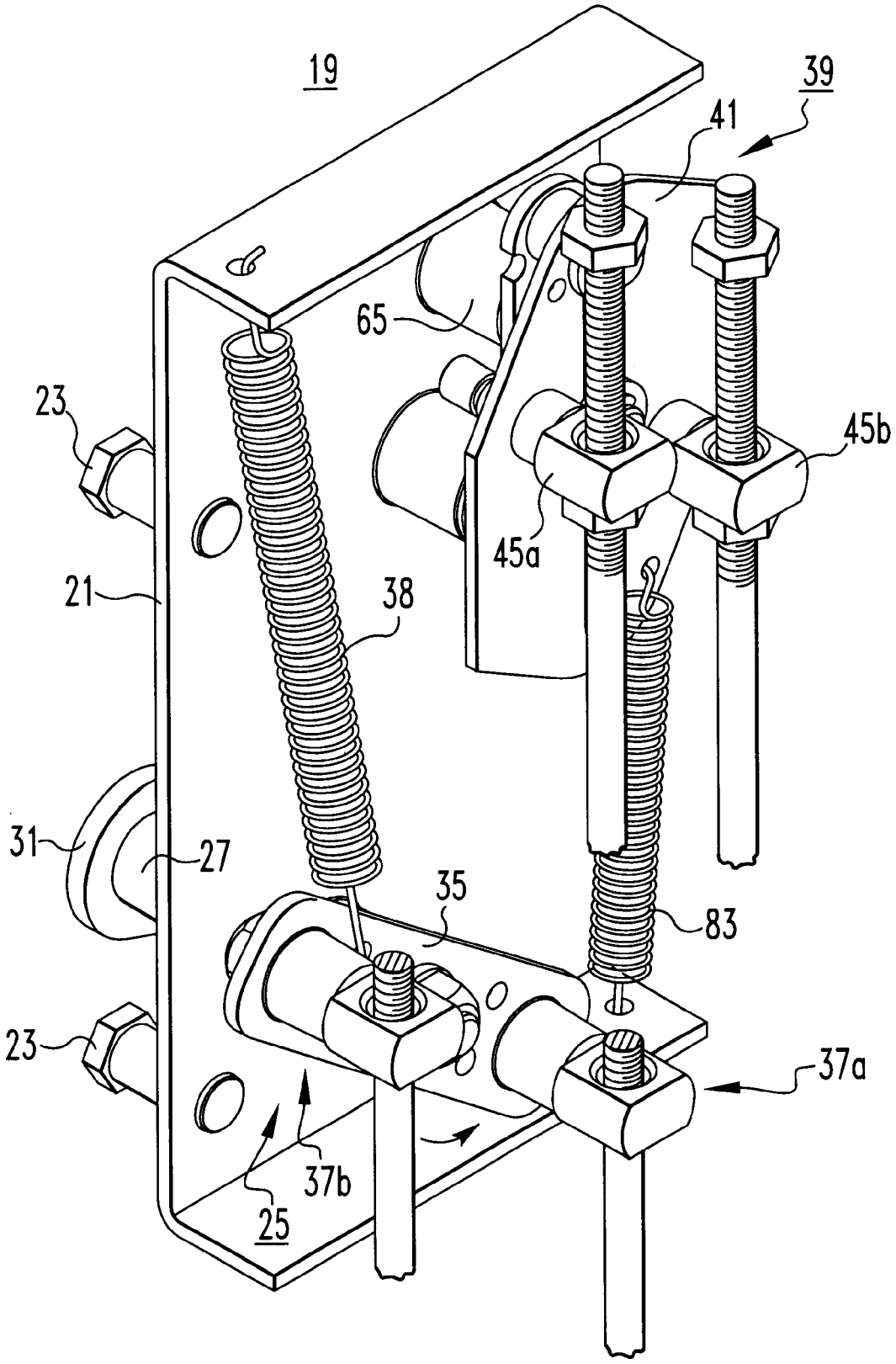
FIG. 3 is an isometric view of the front side of the interlock of FIG. 2.
Figure 4:
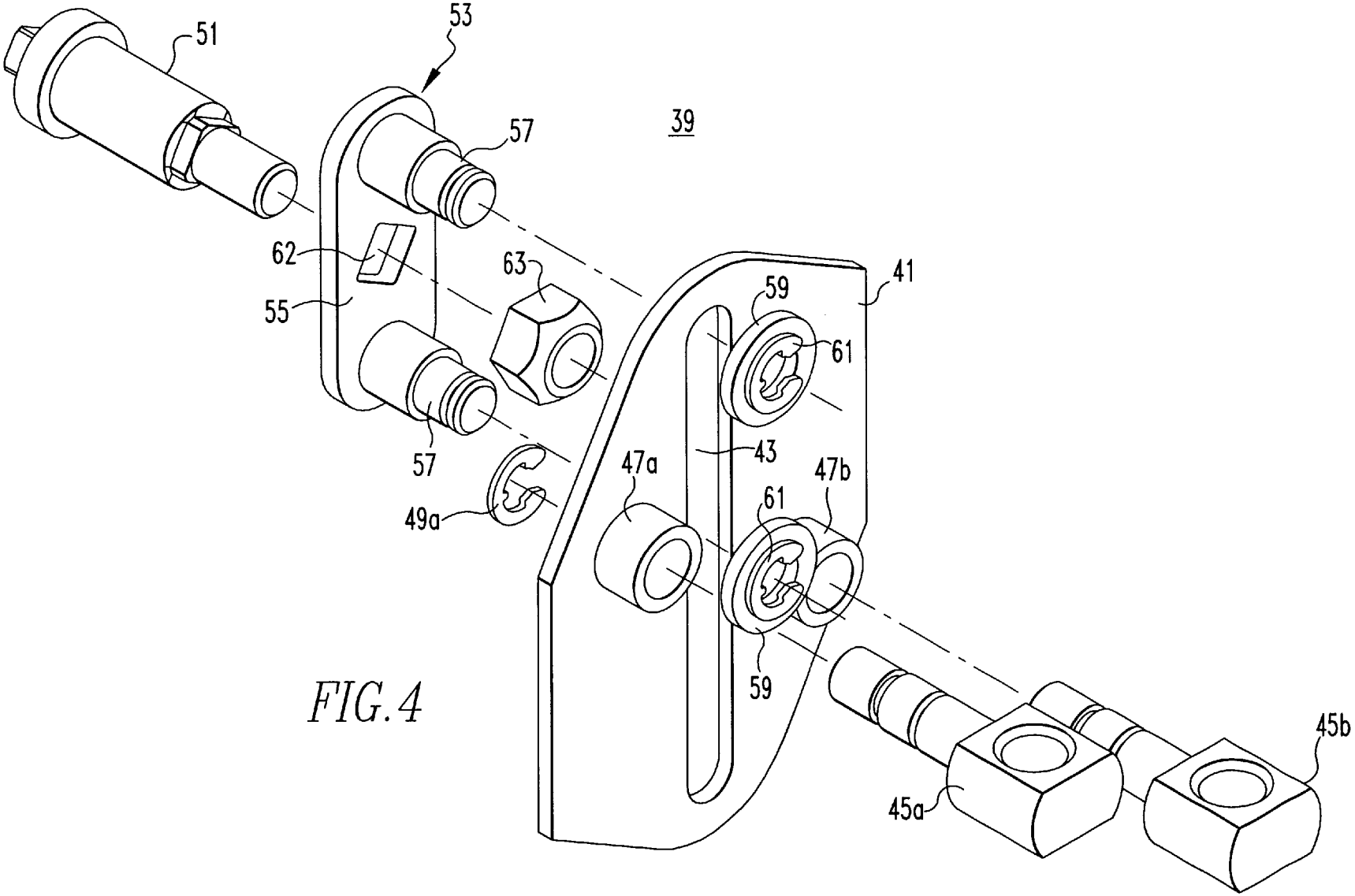
FIG. 4 is an exploded isometric view of a mechanical AND gate which forms part of the interlock shown in FIGS. 2 and 3.

As shown in FIGS. 2 and 3, the interlock unit 19 includes a support plate 21 mounted on the side of the circuit breaker over the state indicator 15 and auxiliary trip bar 17 by standoffs 23. A mechanical drive coupling 25 is coupled to the state indicator 15. The drive coupling 25 includes a shaft 27 journalled in a bearing 29 mounted to the support plate 21. A follower 31 mounted on one end of the shaft 27 is engaged by a drive pin 33 on the state indicator 15. As best seen in FIG. 3, a lever arm 35 is mounted on the opposite end of the shaft 27. At each end of the lever arm 35 is a swivel coupling 37*a* and 37*b*. When the associated circuit breaker 7 is closed, the state indicator is rotated clockwise as viewed in FIG. 2 which in turn rotates the lever arm 35 counterclockwise as viewed in FIG. 3 to raise the swivel 37*a* and at the same time lower the swivel 37*b*. A tension spring 38 maintains the lever arm 35 in an unactuated position. In this interlock system 13, the output of the circuit breaker is applied as an input to the shaft 27 to provide two mechanical outputs which are the opposite motions of the two swivels 37.

The interlock unit 19 also includes a mechanical AND gate 39. Referring to FIGS. 3, 4 and 5A–5D, the AND gate 39 includes a pivot plate 41 with an elongated slot 43. A first input coupling in the form of a swivel 45*a* is pivotally mounted to the pivot plate 41 on a first side of the slot 43 by bearing 47*a* and is retained in place by a snap ring 49*a*. A second input coupling in the form of swivel 45*b* is similarly secured to the pivot plate 41 but on the other or second side of the slot 43 by bearing 47*b* and is likewise retained in place by a snap ring (not visible). An output shaft 51 extend toward and is aligned with the slot 43 in the pivot plate 41. An output coupling 53 is mounted on the output shaft 51 and engages the elongated slot 43. This output coupling 53 includes a coupling arm 55 mounted transversely on the end of the output shaft 51. In order to reduce friction, a pair of shouldered pins 57 are fixed to the ends of the coupling arm 55. The pins 57 extend through the slot 43 in the pivot plate 41 which is retained in place by washers 59 and snap rings 61 engaging the ends of the pins. The lever arm 55 is rotationally locked to the output shaft 51 by a keyed opening 62 and secured thereto by a nut 63. The output coupling 53 provides a connection between the pivot plate 41 and the output shaft 51 which is offset radially from the axis of the shaft. The output shaft 51 is rotationally mounted on the support plate 21 by a bearing 65.

As will be discussed in detail, a mechanical input to both of the input couplings or swivels 45*a* and 45*b* results in a counterclockwise rotation of the output shaft 51 as viewed in FIG. 3. Returning to FIG. 2, this results in clockwise rotation of a reversing cam 67 mounted on the output shaft 51 on the other side of the support plate 21. The reversing cam 67 is coupled to an actuating member 69, pivotally mounted on the support plate 21 by a pin 71, through a drive pin and bearing 73 on the actuating member 69 which engages a drive slot 75 in the reversing cam. The actuating member 69 has a flange 76 on its free end which engages the auxiliary trip bar 17 of the associated circuit breaker. With this arrangement, counterclockwise rotation of the output shaft 51 as viewed in FIG. 4 results in counterclockwise rotation of the actuating member 69 and therefore, the auxiliary trip bar 17 as viewed in FIG. 2.

Figure 6:
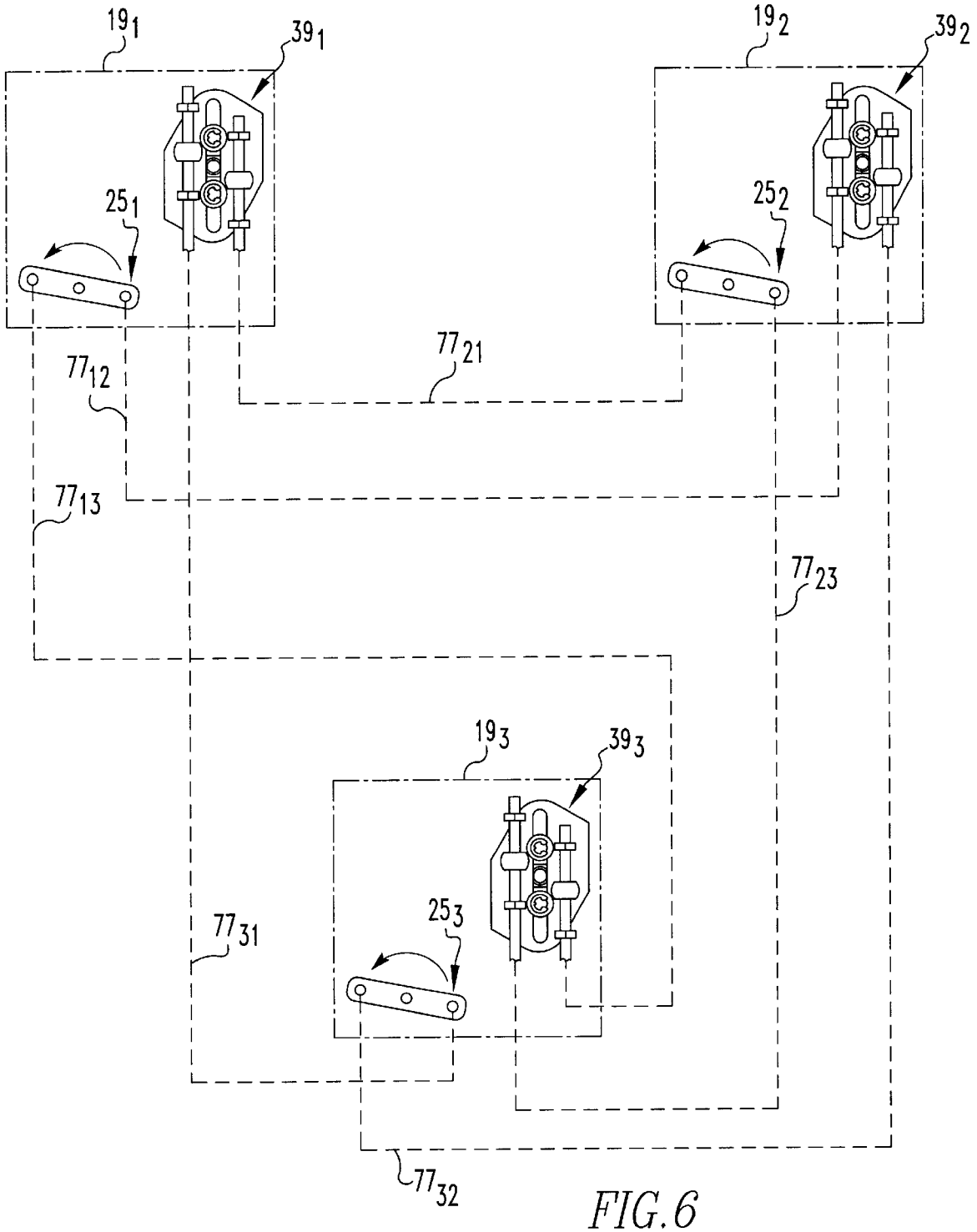
FIG. 6 is a-partially schematic view illustrating the interconnection of the interlocks for the system shown in FIG. 1.

As shown in FIGS. 1 and 6, the interlock units $\mathbf{19}_1$–$\mathbf{19}_3$ on the respective circuit breakers $\mathbf{7}_1$–$\mathbf{7}_3$ are interconnected by elongated actuators $\mathbf{77}_{12}$–$\mathbf{77}_{23}$. In the exemplary system, these elongated actuators are push pull cables; however, rods or tension cables could also be used, depending upon the physical arrangement of the circuits breakers. The cables 77 provide an output from the drive coupling 25 of the interlock unit on each circuit breaker to an input coupling 45 of the AND gate 39 on each of the other circuit breaker which generates the output and the circuit breaker to which that output is applied. For instance, cable $\mathbf{77}_{12}$ connects the drive coupling $\mathbf{25}_1$ associated with the circuit breaker $\mathbf{7}_1$ to an input on the input coupling of the AND gate $\mathbf{39}_2$ on the circuit breaker $\mathbf{7}_2$. The interconnections of the cables is shown schematically in FIG. 6.

The operation of the AND gate $\mathbf{39}_1$ is illustrated in FIG. 5. The other AND gates $\mathbf{39}_2$ and $\mathbf{39}_3$ function similarly. FIG. 5*a* illustrated the initial condition of the AND gate $\mathbf{39}_1$ in which both of the linked circuit breakers $\mathbf{7}_2$ and $\mathbf{7}_3$ are open. Under these conditions, the slot $\mathbf{43}_1$ in the pivot plate $\mathbf{41}_1$ is vertical. Without a biasing spring the location of the output shaft $\mathbf{51}_1$ and the pins 57 of the output coupling $\mathbf{53}_1$ are indeterminate, but for purposes of explanation they are shown approximately midway in the elongated slot $\mathbf{43}_1$. The swivels forming the input couplings 45*a* and 45*b* allow for lost motion during the first portion of travel of the elongated actuators 77, but couple movement of the elongated actuators to the pivot plate $\mathbf{41}_1$ when an abutment surface formed by the lateral surface 78 on a nut forming an end effector 79 engage the swivel ring 80 of the swivel 45. In the initial shown in FIG. 5*a*, each of the a ctuators are illustrated with clearance between therespetive swivels 45 and the end effectors 79.

Figure 5D:
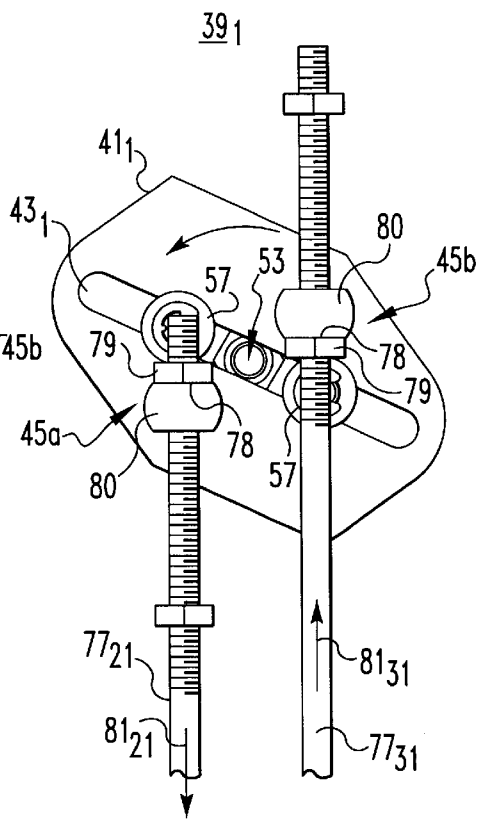
FIGS. 5A–5D are front elevation views of the AND gate shown in the A both input off state, B one input on state, C the other input on state, and D both inputs on state.
Figure 5C:
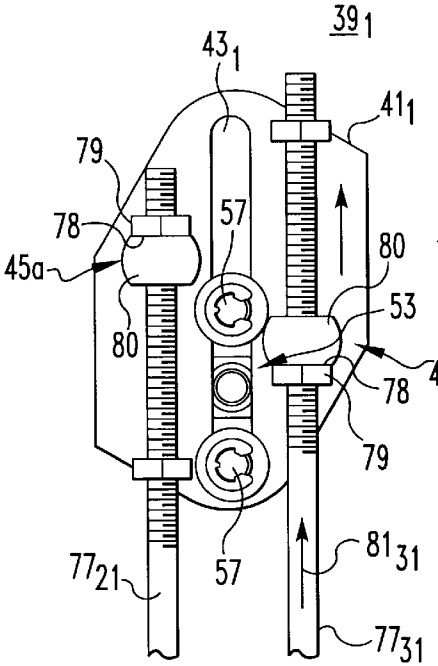
Figure 5B:
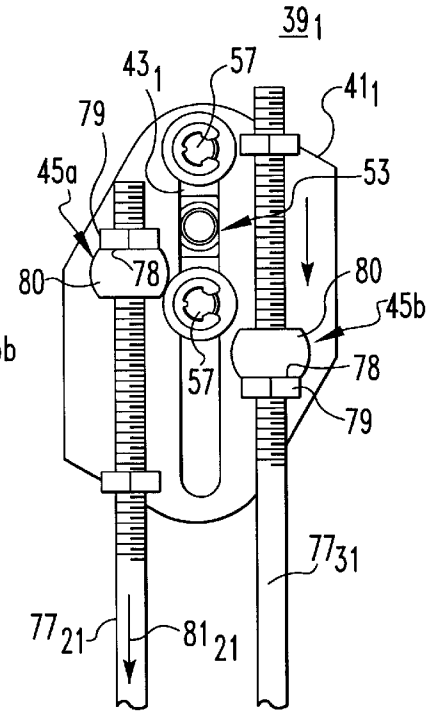
Figure 5A:
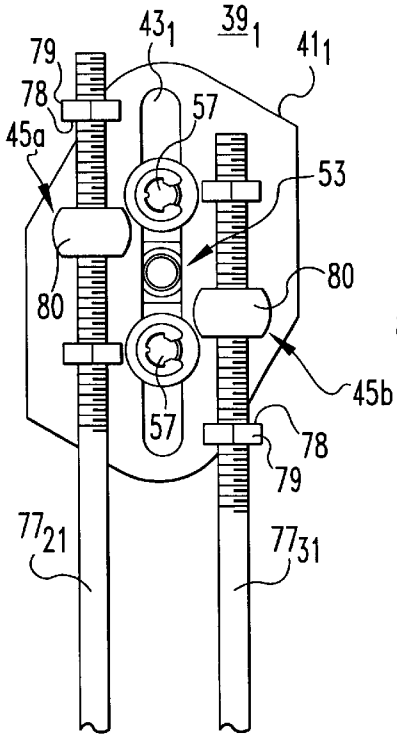

When either elongated actuator $\mathbf{77}_{21}$ or $\mathbf{77}_{31}$ moves its predetermined stroke, the first half of its travel takes up the distance between its end effector 79 and its swivel. The second half of its travel shifts the outer plate vertically on the pivot pins of the output coupling so as to take up the clearance between the other actuator rod and its end effector. Thus, as shown in FIG. 5B, when the elongated actuator $\mathbf{77}_{21}$ is moved axially downward until it engages the swivel 45*a* and then pulls with it at the pivot plate 41 a distance which takes up the clearance between the end effector 79 on the other elongated actuator $\mathbf{77}_{31}$. Similarly, when only the actuator $\mathbf{77}_{31}$ is moved from its OFF to ON position, as shown in FIG. 5C, initially the lost motion between the end effector 79 and the swivel 45*b* of the second input coupling is taken up during the first half of the stroke and during the second half of the stroke the pivot plate $\mathbf{41}_1$ slides vertically upward to take up the clearance between the end effector 79 on the elongated actuator $\mathbf{77}_{21}$ and the swivel 45*a* on the first input coupling. It should be noted that in either case there is no rotary motion but merely a translation of the pivot plate $\mathbf{41}_1$. As can be seen, the longitudinal strokes $\mathbf{81}_{21}$ and $\mathbf{81}_{31}$ are substantially parallel but in opposite directions. It should also be noted that in the neutral position, and with either elongated actuator moved to its ON position, the elongated slot $\mathbf{43}_1$ in the pivot plate $\mathbf{41}_1$ is substantially parallel to the strokes of the elongated actuators.

It can be seen from FIGS. 5B and 5C that with either of the elongated actuators in the ON position, all clearances between the actuators and end effectors has been taken up. Subsequent motion of the other elongated actuator will now produce rotation (and translation) of the pivot plate $\mathbf{41}_1$. The end effector 79 of the first elongated actuator to be moved to the ON position acts as a fulcrum for the motion created by the second elongated actuator causing the rotation of the pivot plate $\mathbf{41}_1$ and therefore, rotation of the output coupling $\mathbf{53}_1$ and the output shaft $\mathbf{51}_1$ as shown in FIG. 5D.

When either one or both of the elongated actuators $\mathbf{77}_{21}$ or $\mathbf{77}_{31}$ are returned to the OFF position, a tension spring 83 (see FIG. 3) returns the pivot plate $\mathbf{41}_1$ to the vertical position. The vertical position of the pivot plate will depend upon which one of the actuators is returned to off first. With the rotation of the pivot plate $\mathbf{41}_1$ back to the vertical position, the output shaft is returned to the off position. Other types of springs can be used to bias the pivot plate, such as a torsion spring.

The lateral spacing of the swivels 45*a* and 45*b* on the pivot plate $\mathbf{41}_1$ are set to be compatible with the actuator stroke used by the drive couplings 25 which they can replace in this arrangement. For instance, where the swivels 37 on the drive couplings 25 are radially offset one inch from the shaft 27, a rotation of the lever arm 35 by the shaft 27 of about 60° will produce about a one-inch stroke. Because the pivot plate $\mathbf{41}_1$ of the AND gate 39 pivots about the fulcrum formed by the first elongated actuator to be moved to the ON position, the swivels 45*a* and 45*b* were positioned one-half inch laterally from the center of the elongated slot 43 to provide a pivot arm of one-inch. Thus, the one-inch stroke of the actuators produces a corresponding about 60° rotation of the output shaft $\mathbf{51}_1$.

While the elongated actuators are shown both extending in the same direction from the interlock units so that one is pushed and one is pulled during 30 actuation, they could extend in opposite directions from the interlock unit so that either both are pulled or both are pushed for actuation. Of course, if tension members are used, they would both have to be pulled for actuation.

The invention provides a simple, reliable, easily manufactured and economical mechanical AND gate which is especially useful for interlocking electric power switches. It also has the advantage of being compatible with and interchangeable with the mechanical OR gates disclosed in the co-pending US application Ser. No. 09/559,089, filed on Apr. 27, 2000 and referenced above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A mechanical AND gate for interlocking multiple electric power switches, the mechanical AND gate comprising:

a pivot plate having an elongated slot;

a first input coupling mounted on the pivot plate at a point laterally offset on a first side of the elongated slot;

a second input coupling mounted on the pivot plate at a point laterally offset on a second side of the elongated slot;

an output shaft extending transversely toward the pivot plate and aligned with the elongated slot;

an output coupling mounted on but radially offset from an axis of the output shaft and engaging and slideable relative to the pivot plate in the elongated slot;

a first elongated actuator engaging the first input coupling and axially moveable between an ON position and an OFF position;

a second elongated actuator engaging the second input coupling and axially moveable between an ON and an OFF position; and the first and second input couplings being structured to only transfer force from the first and second elongated actuators, respectively, to the pivot plate with movement of the first and second elongated actuators, respectively, to the ON position, so that the pivot plate slides relative to the output coupling engaging the elongated slot when only one of the first and second elongated actuator moves to the ON position, and the pivot plate rotates to rotate the output coupling and therefore the output shaft, only when both the first and second elongated actuators are moved to the ON position.

2. The mechanical AND gate of claim 1 wherein said first and second elongated actuators are positioned to move along substantially parallel strokes in opposite directions from the OFF to ON positions and the pivot plate has an OFF position in which the elongated slot is substantially parallel to the strokes of the first and second elongated actuators.

3. The mechanical AND gate of claim 2 wherein the first and second input couplings are structured and positioned to provide lost motion between either of the first and second elongated actuators, respectively, and the pivot plate when the other of the first and second elongated actuators moves to the ON position and translates the pivot plate, the lost motion being taken up as the other of the first and second elongated actuators reaches its ON position.

4. The mechanical AND gate of claim 3 wherein the first and second input couplings are slip couplings comprising a coupling element which slides relative to the elongated actuator to provide the lost motion, and which engages an abutment surface on the elongated actuator to couple the elongated actuator to the pivot plate when the lost motion is taken up.

5. The mechanical AND gate of claim 4 wherein the coupling element is a swivel including a swivel ring through which the elongated actuator slides, and the abutment surface is provided on the elongated actuator by a laterally extending surface on an end effector which engages the swivel ring.

6. The mechanical AND gate of claim 5 wherein the output coupling comprises a coupling arm extending transversely to the axis of the output shaft and a pair of pins on the coupling arm with an axis extending parallel to and on opposite sides of the axis of the output shaft.

7. The mechanical AND gate of claim 4 wherein the coupling element is a swivel including a swivel ring through which the elongated actuator slides, and the abutment surface is provided on the elongated actuator by a laterally extending surface on an end effector which engages the swivel ring.

8. An electric power distribution system comprising:

three electric power switches each having an open state and a closed state, an indicator indicating the state that the electric power switch is in, and an auxiliary trip input which holds the electric power switch in the open state when actuated; and a mechanical AND gate associated with each electric power switch and comprising:

a pivot plate having an elongated slot;

a first input coupling mounted on the pivot plate at a point laterally offset on a first side of the elongated slot;

a second input coupling mounted on the pivot plate at a point laterally offset on a second side of the elongated slot;

an output shaft coupled to the auxiliary trip input of the associated electric power switch and rotatable to actuate the associated auxiliary trip input;

an output coupling mounted on but radially offset from an axis of the output shaft and engaging and slideable relative to the pivot plate in the elongated slot;

a first elongated actuator engaging the first input coupling and coupled to the state indicator of one of the other electric power switches, the first elongated actuator being axially moveable between an ON position and an OFF position of the other electric power switch; and a second elongated actuator engaging the second input coupling and coupled to the state indicator of another of the electric power switches, the second elongated actuator being axially moveable between an ON position and an OFF position of the another electric power switch, the first and second input couplings being structured to only transfer force from the first and second elongated actuator, respectively, to the pivot plate when the state indicators of both the one and the another of the other two electric power switches are in the ON state, such that only two of the three electric power switches can be in the ON state at the same time.

9. The electric power distribution system of claim 8 wherein said first and second elongated actuators are positioned to move along substantially parallel strokes in opposite directions from the OFF to ON positions and the pivot plate has an OFF position in which the elongated slot is substantially parallel to the strokes of the first and second elongated actuators.

10. The electric power distribution system of claim 9 wherein the first and second input couplings are structured and positioned to provide lost motion between either the first and second elongated actuator, respectively, and the pivot plate when the other of the first and second elongated actuators moves to the ON position and translates the pivot plate, the lost motion being taken up as the other of the first and second elongated actuators reaches its ON position.

11. The electric power distribution system of claim 10 wherein the first and second input couplings are slip couplings comprising a coupling element which slides relative to the elongated actuator to provide the lost motion, and which engages an abutment surface on the elongated actuator to couple the elongated actuator to the pivot plate when the lost motion is taken up.

12. The electric power distribution system of claim 11 wherein the coupling element is a swivel including a swivel ring through which the elongated actuator slides, and the abutment surface is provided on the elongated actuator by a laterally extending surface on an end effector which engages the swivel ring.

13. The electric power distribution system of claim 12 wherein the output coupling comprises a coupling arm extending transversely to an axis of the output shaft and a pair of pins on the coupling arm with an axis extending parallel to and on opposite sides of the axis of the output shaft.

14. The electric power distribution system of claim 11 wherein the coupling element is a swivel including a swivel ring through which the elongated actuator slides, and the abutment surface provided on the elongated actuator by a laterally extending surface on an end effector which engages the swivel ring.

* * * * *